US005576692A

United States Patent [19]

Tompkins et al.

[11] Patent Number: 5,576,692

[45] Date of Patent: Nov. 19, 1996

[54] NATIONWIDE AIRPORT LUGGAGE TRACKING SYSTEM AND METHOD

[76] Inventors: Eugene Tompkins, 1016 E. Warren, Detroit, Mich. 48224; William Hayes, 24150 Inkster Rd., Southfield, Mich. 48034

[21] Appl. No.: 494,889

[22] Filed: Jun. 26, 1995

Related U.S. Application Data

[63] Continuation-in-part of Ser. No. 208,512, Mar. 10, 1994, abandoned.

[51] Int. Cl.[6] ..... G08B 13/14

[52] U.S. Cl. ..... 340/571; 340/825.44

[58] Field of Search ..... 340/571, 572, 340/573, 825.44, 825.45, 539

[56] References Cited

U.S. PATENT DOCUMENTS

| | | | |
|---|---|---|---|
| 4,476,469 | 10/1984 | Lander | 340/825.49 |
| 4,918,425 | 4/1990 | Greenberg et al. | 340/572 |
| 4,922,229 | 5/1990 | Guenst | 340/572 |
| 5,021,794 | 6/1991 | Lawrence | 340/573 |
| 5,122,795 | 6/1992 | Cubley et al. | 340/825.44 |

*Primary Examiner*—Jeffery Hofsass
*Assistant Examiner*—Benjamin C. Lee
*Attorney, Agent, or Firm*—Young & Basile, P.C.

[57] ABSTRACT

A system and method of tracking luggage pieces in any airport across a wide geographic area involves the attaching of a beeper paging unit to each luggage piece and causing any selected beeper units to beep wherever located in a geographic area served by a paging system.

4 Claims, 1 Drawing Sheet

NATIONWIDE AIRPORT LUGGAGE TRACKING SYSTEM AND METHOD

RELATED APPLICATION

This application is a continuation-in-part of U.S. patent application Ser. No. 08/208,512 filed on Mar. 10, 1994 now abandoned.

BACKGROUND OF THE INVENTION

This invention concerns tracking/locating systems for luggage handled by airline companies.

Handling of luggage by the airline companies faces particular problems, due to the far flung nature of the route system. If luggage is misrouted it can end up hundreds or even thousands of miles from its proper destination. Locating misrouted luggage in a timely fashion is important to customer satisfaction.

There has heretofore been proposed interrogatory-transponder systems for locating objects, as for example, see U.S. Pat. Nos. 5,266,925 and 5,214,410.

While useful in a particular location, these systems do not solve the above described problem with respect to airlines handling luggage—and quickly retrieving misrouted luggage—over a wide geographic area.

SUMMARY OF THE INVENTION

The present invention utilizes a nationwide paging system to track and locate luggage items anywhere in the geographic area in which the paging system operates, as for example, anywhere in the United States.

The tracking and locating is accomplished by assigning a sounding paging device or "beeper" to each luggage item to be tracked. Each beeper may be physically attached to a respective luggage item by a strap.

Each beeper has its own unique number and code with suitable decoding circuit. Upon misrouting of the luggage item, a tracking initiative is brought into action, involving "calling" of the number of the missing item through the nationwide paging system. The missing item is thus caused to "beep" at whatever airport it is located.

The local baggage handling personnel are thus alerted to the presence of a misrouted item of luggage and can telephone a dispatch center or a particular searching airport to inform them of its whereabouts in a very prompt fashion.

The pager devices are intended for continuous reuse as they again become available at the completion of the routing of the originally assigned luggage item.

DETAILED DESCRIPTION OF THE PREFERRED EMBODIMENT

In the following detailed description, certain specific terminology will be employed for the sake of clarity and a particular embodiment described in accordance with the requirements of 35 U.S.C. 112, but it is to be understood that the same is not intended to be limiting and should not be so construed inasmuch as the invention is capable of taking many forms and variations within the scope of the appended claims.

According to the concept of the present invention a nationwide paging system is utilized.

The paging system may comprise an existing system or a specialized dedicated system installed by a using airline or group of airlines.

U.S. Pat. No. 4,178,476 issued on Dec. 11, 1979 for an "Automatic Nationwide Paging System" describes various prior art systems.

Figure 1:
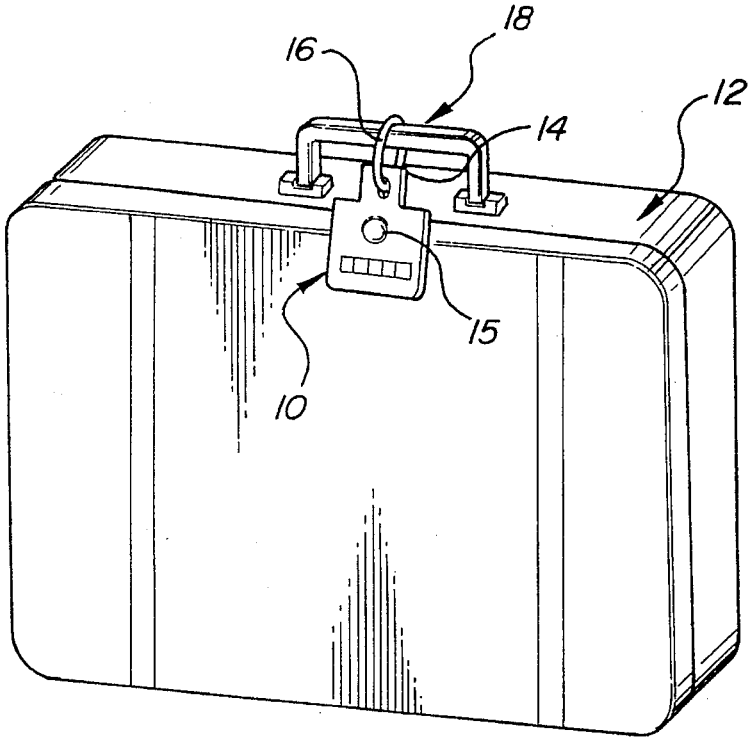
FIG. 1 is a perspective view of a luggage item having a beeper unit attached as a part of the method according to the present invention.
Figure 2:
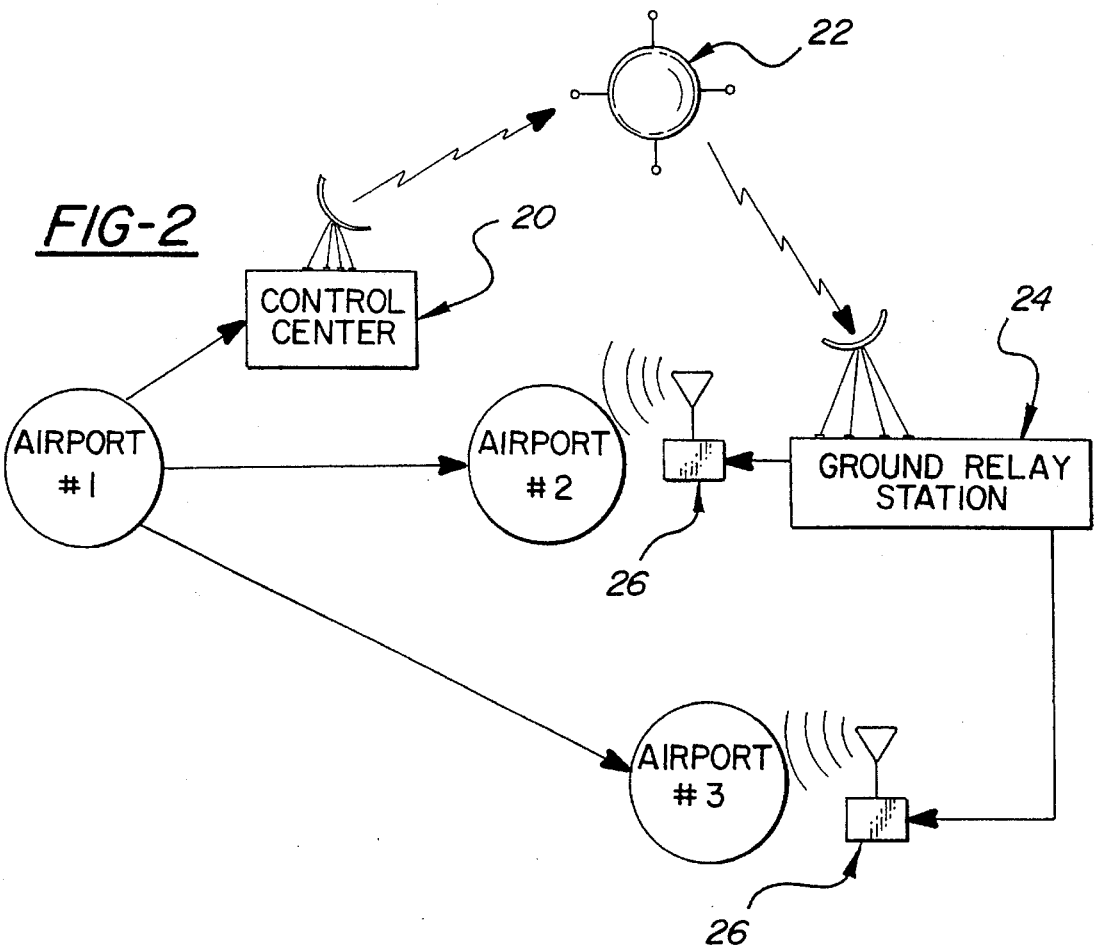
FIG. 2 is a diagrammatic representation of the system according to the present invention.

According to the system of the present invention, a "beeper" or pager unit 10 is assigned to each luggage piece 12 to be tracked or located (FIG. 1). The beeper unit 10 may be of essentially conventional design, but configured with an eye portion 14 adapted to be detachably secured to the luggage piece 12, as with a cinch 16 passed around the handle 18 of the luggage piece 12 and through the eye of eye portion 14.

The beeper unit 10 receives an RF signal which is decoded by circuitry to respond with an audible signal if the RF signal corresponding to the number and tone unique to each beeper unit 10 is received.

Preferably, each piece of luggage to be tracked is equipped with an individual assigned beeper unit 10 having a unique coding, and the respective codes of the beepers attached to the respective luggage pieces are suitably recorded. Alternatively, one out of each group of luggage pieces of a passenger may be assigned a beeper unit 10 in order to reduce the total number of beeper units 10 required.

The luggage piece 12 having a beeper unit 10 attached may be lost as by a misrouting. That is, whereas the passenger may be properly transported from airport 1 to airport 2, his luggage may be misrouted to airport 3.

According to the invention, upon arrival of a particular flight at airport 2 from airport 1, the luggage pieces of the passengers on that flight are checked or inventoried to ascertain whether all of the luggage pieces have arrived. This inventorying may be done by luggage personnel at airport 2 or, more commonly, may be effected by the passengers attempting to retrieve their individual items of luggage at the baggage claim area at airport 2. In either case, when it is determined that a piece of luggage is missing, the recorded information with respect to the beeper codes and luggage pieces is suitably accessed to determine the code of the beeper assigned to the missing luggage piece and a signal bearing the code of the assigned beeper is transmitted to all airports in a network of airports in a geographic area causing the beeper attached to the missing luggage piece to emit an audible signal and thereby identify the missing luggage piece and alert a luggage attendant that the emitting luggage piece is the object of a lost luggage search.

Specifically, once it has been determined that a luggage piece intended for transport to airport 2 has not arrived at airport 2, the baggage personnel at either airport 1 or airport 2 may contact a control center 20, as by telephone, which control center 20 uplinks signals corresponding to the code of the beeper unit 10 assigned to the missing luggage piece 12 to a geosynchronous satellite 22.

The satellite 22 in turn downlinks the data to a series of ground relay stations 24. The relay stations 24 relay the page signal to local transmitters 26, serving each airport in the system.

If the beeper unit is at airport 3 it will receive the local signal and emit an audible signal.

The beeper unit 10 can also display the number of the calling airport using a conventional known pager feature, so that the local baggage personnel at airport 3 can call airport 1 or 2 to report the location of the missing luggage piece 12.

A clearing house "800" telephone number can also be used as a variation.

As noted, either existing paging systems of various forms can be used or a dedicated airline paging system may be employed.

We claim:

1. A method of locating a piece of luggage lost in transit between a system of airports in a defined geographic area, the method comprising the steps of:

at a first airport in the system, collecting a series of luggage pieces intended for transport to a second airport in the system;

attaching a series of pagers of various codes to the series of luggage pieces;

recording the respective codes of the pagers attached to the respective luggage pieces in the series;

transporting the luggage pieces to the second airport;

inventorying the series of luggage pieces upon arrival at the second airport to identify a missing luggage piece in the series;

checking the recorded pager codes to determine the code of the pager corresponding to the missing luggage piece;

transmitting a radio signal of a unique code corresponding to the code of the pager attached to the missing luggage piece to all airports in the system to activate the pager attached to the missing luggage piece to emit an audible signal to alert a luggage attendant that the emitting luggage piece is the object of a lost luggage search;

transmitting a signal to the second airport to report the location of the missing luggage piece;

transporting the missing luggage piece to the second airport; and removing the pagers from the luggage pieces for reuse in carrying out the above steps with respect to a new series of luggage pieces intended for transport to another airport in the system.

2. A method according to claim 1 wherein each pager upon activation is caused to display a telephone number corresponding to the transmitting location.

3. A method according to claim 1 wherein the step of transmitting a radio signal of the unique code comprises providing a local paging RF transmitter at each airport within the system and causing each of the RF transmitters to transmit a radio signal of the unique code.

4. A method according to claim 3 wherein the step of causing each of the local paging RF transmitters to transmit a radio signal of the unique code comprises providing a geosynchronous satellite and a ground relay station, uplinking a radio signal of the unique code to the satellite, downlinking a radio signal of the unique code to the ground relay station, and transmitting a radio signal of the unique code to each of the local paging RF transmitters.

* * * * *